US006671910B2

(12) United States Patent
Hsu et al.

(10) Patent No.: US 6,671,910 B2
(45) Date of Patent: Jan. 6, 2004

(54) INFLATABLE BED

(75) Inventors: Yaw-Yuan Hsu, Taipei (TW); Chin-Hsiang Pan, Taipei (TW)

(73) Assignee: Intex Recreation Corp., Long Beach, CA (US)

( * ) Notice: Subject to any disclaimer, the term of this patent is extended or adjusted under 35 U.S.C. 154(b) by 0 days.

(21) Appl. No.: 10/007,681

(22) Filed: Dec. 5, 2001

(65) Prior Publication Data

US 2003/0101516 A1 Jun. 5, 2003

(51) Int. Cl.[7] ..... A47C 27/10
(52) U.S. Cl. ..... 5/710; 5/711
(58) Field of Search ..... 5/710, 711, 712, 5/713, 706, 644, 654, 655.3, 932

(56) References Cited

U.S. PATENT DOCUMENTS

| | | | | | |
|---|---|---|---|---|---|
| 2,604,641 | A | * | 7/1952 | Reed | 5/710 X |
| 3,644,949 | A | * | 2/1972 | Diamond | 5/644 X |
| 3,978,530 | A | * | 9/1976 | Amarantos | 5/710 X |
| 4,389,742 | A | * | 6/1983 | DeWitt | 5/654 |
| 4,504,989 | A | * | 3/1985 | Maltz | 5/655.3 |
| 4,639,960 | A | * | 2/1987 | Quillen et al. | 5/710 |
| 4,685,163 | A | * | 8/1987 | Quillen et al. | 5/644 X |
| 4,724,558 | A | * | 2/1988 | Reiff | 5/655.3 X |
| 4,964,183 | A | * | 10/1990 | LaForce, Jr. | 5/710 X |
| 5,044,030 | A | * | 9/1991 | Balaton | 5/710 |
| 5,247,712 | A | * | 9/1993 | Williams | 4/585 |
| 5,421,044 | A | * | 6/1995 | Steensen | 5/710 |
| 5,561,873 | A | * | 10/1996 | Weedling | 5/711 |
| 5,699,569 | A | * | 12/1997 | Schwarz-Zohrer | 5/655 |
| 5,729,840 | A | * | 3/1998 | Wu | 4/588 |
| 5,890,245 | A | * | 4/1999 | Klearman et al. | 5/710 X |
| 6,073,291 | A | * | 6/2000 | Davis | 5/711 |
| 6,076,214 | A | * | 6/2000 | Klimenko | 5/710 |
| D464,225 | S | * | 10/2002 | Boso et al. | D6/604 |
| 2003/0024050 | A1 | * | 2/2003 | Boso et al. | 5/711 |
| 2003/0101516 | A1 | * | 6/2003 | Hsu et al. | 5/710 |

* cited by examiner

*Primary Examiner*—Robert G. Santos
(74) *Attorney, Agent, or Firm*—Lewis, Brisbois, Bisgaard & Smith LLP

(57) ABSTRACT

An inflatable bed includes an inflatable mattress that is attached to the top surface of an inflatable air box spring. An inflatable, stabilizing tube is attached to the bottom of the air box spring to provide additional stability and height by increasing the footprint of the inflatable bed. The interiors of the inflatable mattress and air box spring contain a plurality of I-beam structures arranged longitudinally to provide further support and stability. Alternatively, the inflatable mattress is separate and detachable and can be fastened to the top surface of the air box spring. An additional stabilizing tube is attached to the periphery of the top surface of the air box spring to cradle and support the detachable inflatable mattress.

15 Claims, 6 Drawing Sheets

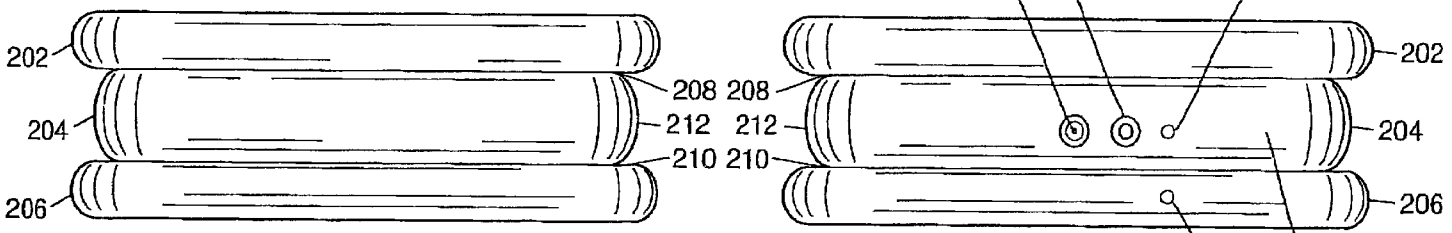
FIG. 10
FIG. 11
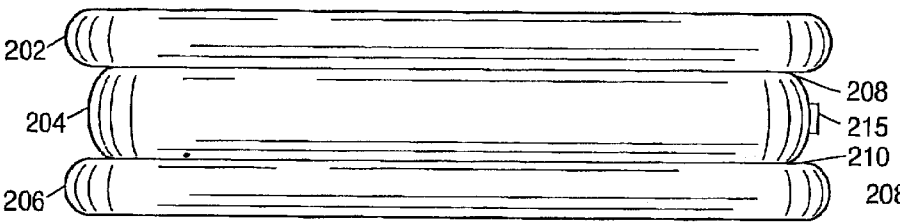
FIG. 12
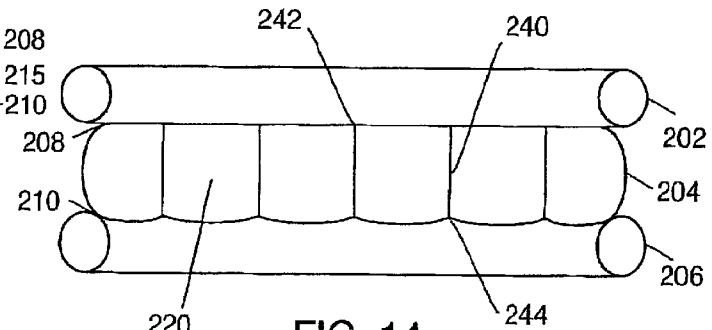
FIG. 14
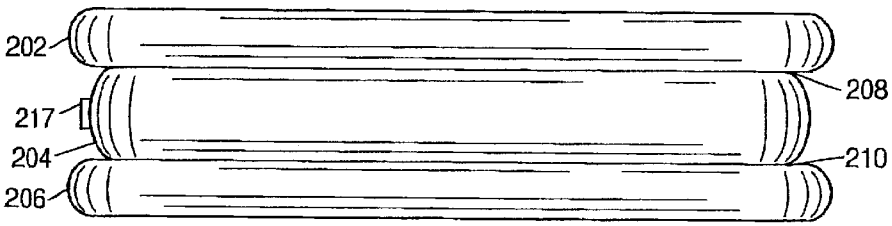
FIG. 13

INFLATABLE BED

BACKGROUND OF THE INVENTION

1. Field of the Invention

The present invention relates to an inflatable bed, and more particularly, to a combination of an air mattress, an air box spring, and stabilizing tubes.

2. Description of the Related Art

Air mattresses have enjoyed wide popularity for a number of reasons. When not in use, the air mattress is capable of being deflated to a substantially two-dimensional geometry which can be folded compactly and stored and transported quite easily. When inflated, air mattresses provide the user with a generally high level of comfort as the user is literally supported upon a cushion of air isolating the user from what would be an otherwise uncomfortable sleeping surface such as natural terrain encountered on a typical camping excursion.

However, there are several disadvantages to the use of conventional inflatable air mattresses. Such mattresses situate users in undesirably close proximity to the ground surface and often do not provide a sufficiently comfortable sleeping surface. In conventional bedding, a box spring is placed underneath a mattress to support the mattress and provide additional comfort and insulation to the user. Without a box spring, a sleeping surface provided only by a mattress may be uncomfortably firm and the coldness retained by the ground surface underneath is transferred to the user via the mattress. Since air mattresses provide much less insulation than conventional mattresses from cold, hard surfaces, such as a campground, an additional layer would be required for both insulation and comfort.

Another disadvantage of conventional air mattresses is that there is insufficient height for the mattress to act as a suitable sitting surface and a sleeping surface for elderly individuals. Conventional bedding, which includes a mattress and a box spring, is of adequate height to provide a comfortable sitting surface and facilitates the process for elderly individuals to get in and out of bed. To utilize conventional air mattresses as a sitting surface, the user must expend much more energy in lowering and raising his body. For the elderly, a greater and taxing effort of getting into and out of bed is required.

To compensate for these disadvantages, prior art has suggested the use of separate but attached chambers to increase the height. However, increased height in inflatable bedding results in instability when weight is applied to the periphery of the top surface of the bedding. If a user sits on one corner of the air mattress, the air mattress is likely to tilt up and unsettle any objects and the user off of the mattress. Therefore, there is a need for an inflatable bed that conveniently provides a raised and stable sleeping surface. There is also a need for an inflatable bed that allows the user to attach an inflatable mattress to a base by means such as hook and loop means should the user choose to do so.

SUMMARY OF THE INVENTION

Accordingly, the present invention is directed to an inflatable bed that substantially obviates one or more of the problems due to limitations and disadvantages of the related art.

It is an object of the present invention to provide an inflatable bed which characteristically creates a generally stable, comfortable and raised sleeping surface.

It is a further object of the present invention to provide an inflatable bed that reduces heat loss by the user to the ground surface by reducing the surface contact area of the bottom surface of the bed with the ground surface.

It is another object of the present invention to provide an inflatable bed that is easily and quickly inflated and deflated, and able to be stored conveniently.

It is another object of the present invention to provide an inflatable bed that is aesthetically pleasing, secure, and comfortable to use.

An object of an alternative embodiment of the present invention is to provide an inflatable bed that allows the user to determine the height and firmness of the sleeping surface.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an inflatable bed comprises an inflatable mattress with a top layer sealed to a bottom layer through a wall, wherein the bottom and top layers and the wall define an outer frame of the inflatable mattress; an inflatable box spring with a top layer sealed to a bottom layer through a wall, wherein the bottom and top layers and the wall define an outer frame of the inflatable box spring; and a stabilizing tube attached around a periphery of an outer frame of the bottom layer of the inflatable box spring to provide further stability.

According to one aspect of the present invention, the bottom layer of the inflatable mattress is the same as the top layer of the air box spring.

According to another aspect of the present invention, a plurality of I-beam sealing structures are longitudinally disposed between and are attached to a bottom surface of the top layer and a top surface of the bottom layer of the inflatable mattress. In addition, a plurality of I-beam sealing structures are longitudinally disposed between and are attached to a bottom surface of the top layer and a top surface of the bottom layer of the inflatable box spring.

According to another aspect of the present invention, an outer periphery of the stabilizing tube is larger than an outer periphery of the inflatable box spring to provide stability.

According to another embodiment of the present invention, an inflatable bed comprises an inflatable mattress with a top layer sealed to a bottom layer through a wall, wherein the bottom and top layers and the wall define an outer frame of the inflatable mattress; an inflatable box spring with a top layer sealed to a bottom layer through a wall, wherein the bottom and top layers and the wall define an outer frame of the inflatable box spring; a first stabilizing tube attached to the periphery of an outer surface of the top layer of the inflatable box spring to provide stability to the inflatable mattress disposed on the inflatable box spring; and a second stabilizing tube attached to a periphery of an outer surface of the bottom layer of the air box spring to provide further stability. Preferably, the inflatable mattress is detachable from the inflatable box spring.

According to one aspect of the present invention, the inflatable mattress includes loop fasteners disposed on the bottom surface of the inflatable mattress. The inflatable box spring further includes hook and loop fasteners and corresponding straps disposed on the top surface of the box spring so as to fasten to the corresponding loop fasteners disposed on the bottom surface of the inflatable mattress.

According to another aspect of the present invention, an outer periphery of the second stabilizing tube is larger than an outer periphery of the inflatable box spring to provide stability.

It is to be understood that both the foregoing general description and the following detailed description are exemplary and explanatory and are intended to provide a further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention.

FIG. 10 illustrates a posterior view of the second embodiment of the present invention;

FIG. 11 illustrates a frontal view of the second embodiment of the present invention;

FIG. 12 illustrates a right side view of the second embodiment according to the present invention;

FIG. 13 illustrates a left side view of the second embodiment according to the present invention;

FIG. 14 illustrates a cross-sectional view of the second embodiment of the present invention;

DETAILED DESCRIPTION OF THE PREFERRED EMBODIMENTS

With reference to the drawings, and in particular to FIGS. 1–16 thereof, an inflatable bed embodying the principles and concepts of the present invention will be described.

Figure 1:
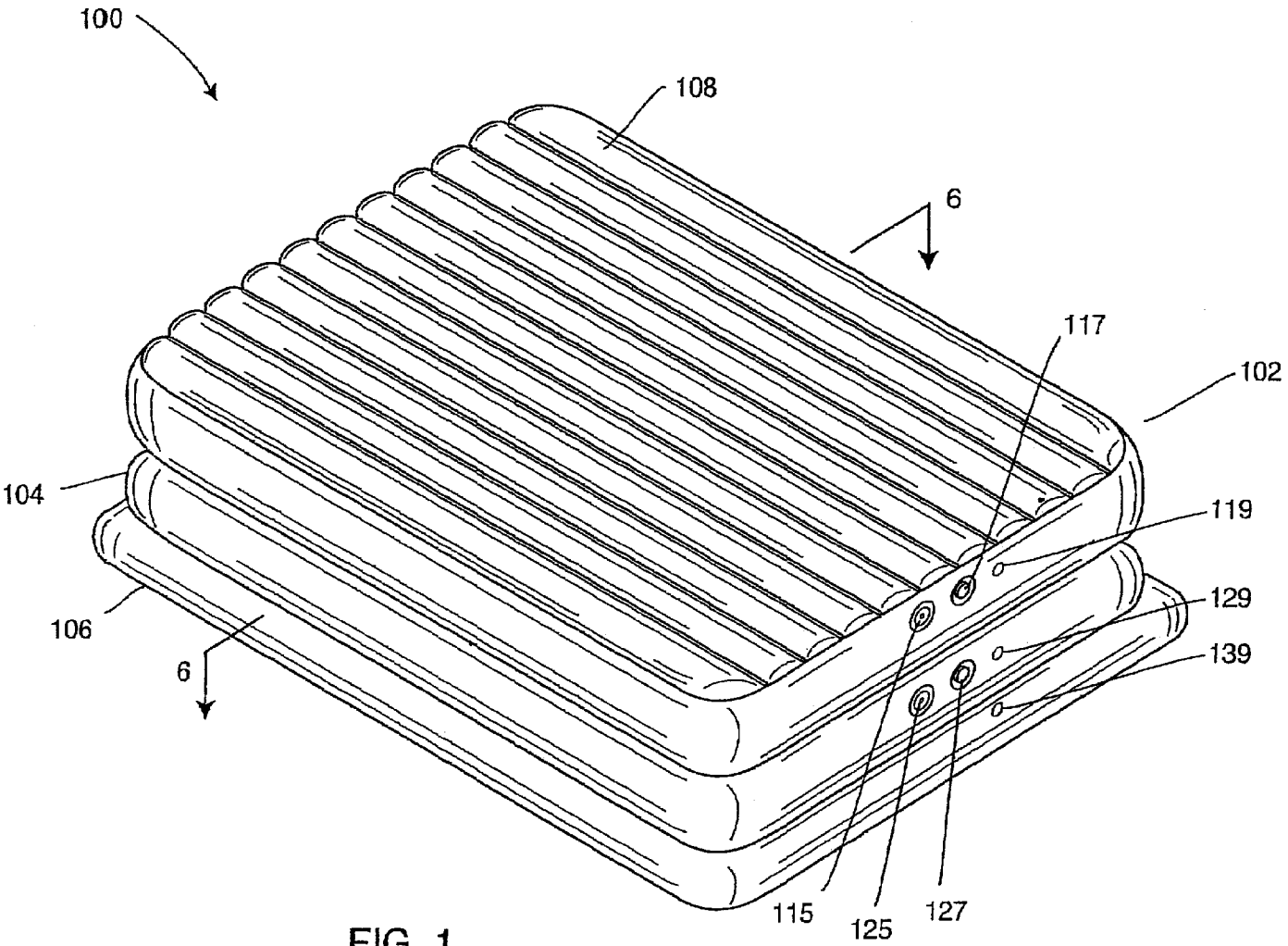
FIG. 1 illustrates a perspective view of an inflatable bed according to a first embodiment of the present invention.
Figure 3:
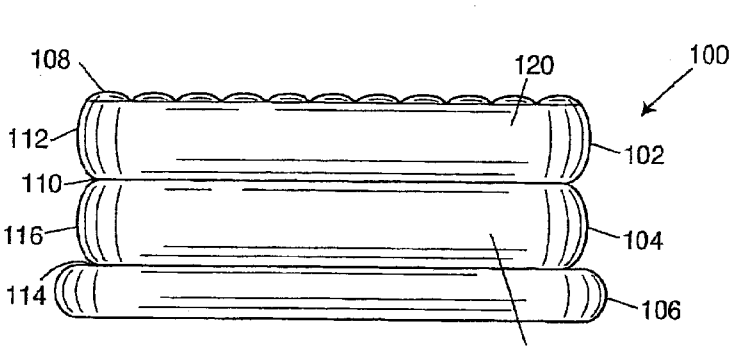
FIG. 3 illustrates a posterior view of the first embodiment of the present invention.
Figure 2:
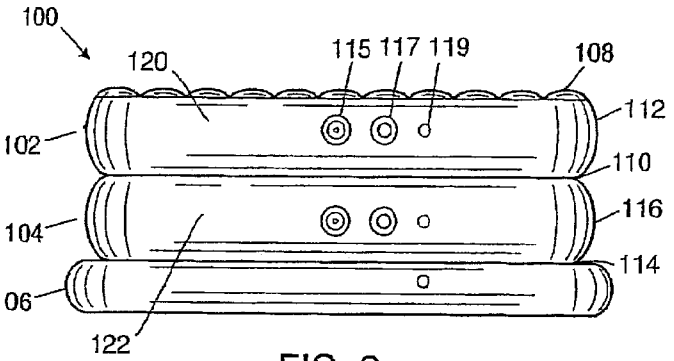
FIG. 2 illustrates a frontal view of the first embodiment of the present invention.
Figure 4:
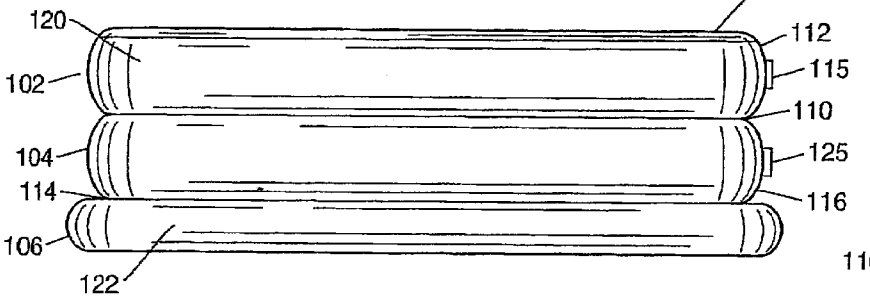
FIG. 4 illustrates a right side view of the first embodiment according to the present invention.
Figure 5:
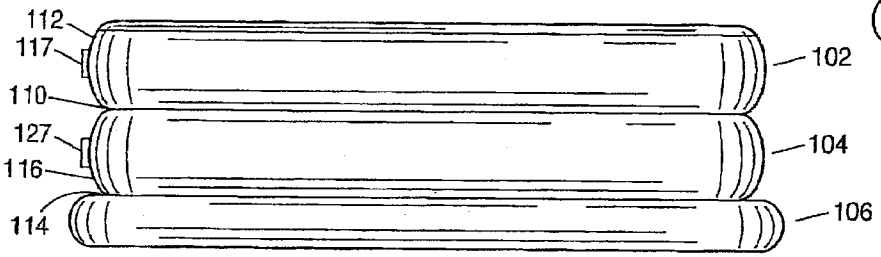
FIG. 5 illustrates a left side view of the first embodiment according to the present invention.

FIG. 1 illustrates a perspective view of the inflatable bed 100 according to the first embodiment of the present invention. FIGS. 2 and 3 illustrate frontal and posterior views, respectively, of the inflatable bed 100. FIGS. 4 and 5 illustrate right side and left side views, respectively, of the inflatable bed 100.

Referring to FIGS. 1–5, the inflatable bed 100 comprises a top inflatable mattress 102, an air or inflatable box spring 104 attached underneath to the inflatable mattress 102, and an airtight stabilizing tube 106 attached to the periphery of the bottom surface of the air box spring 104. The inner perimeter of the stabilizing tube 106 is equivalent to the outer perimeter of the air box spring 104. The vertical direction arrows 6 in FIG. 1 refer to FIG. 6, which depicts the cross-sectional view of the inflatable bed.

The inflatable mattress 102 is comprised of a top layer 108 that is sealed to a bottom layer 110 through a wall 112. These three components define the outer frame of the air mattress 102 and create an airtight chamber 120. The bottom layer 110 is shared by the top layer of the air box spring 104. Preferably, the bottom layer 110 is the top layer of the air box spring 104. The outer frame of the air box spring 104 comprises a top layer 110 that is sealed to a bottom layer 114 through a wall 116, thereby creating an airtight chamber 122. Preferably, the wall 116 is of greater length than the wall 112. The stabilizing tube 106 is attached to the outer periphery of the bottom layer 114 of the air box spring 104 by radio frequency sealing (RF) or other means known to one of ordinary skill in the art. The air mattress 102, the air box spring 104, and the stabilizing tube 106 are not in gaseous or fluid communication with each other.

In the preferred embodiment, the material for all layers 108, 110, 114, walls 112 and 116, and stabilizing tube 106 are comprised of a flexible and resilient material, such as polyvinyl chloride sheeting (typically referred to as PVC), thermoplastic impregnated cloth or other materials known to one of ordinary skill in the art. The edges of the walls 112, 116 are fused with the top and bottom layers 108, 110, 114 using such process as radio frequency (RF) sealing or other process known to one of ordinary skill in the art. The stabilizing tube 106 is fused to the periphery of the bottom surface of the air box spring 104 using RF sealing or other processes known to one of ordinary skill in the art. Alternatively, the stabilizing tube 106 may be fastened to the air box spring 104 by using any suitable fastener known to one of ordinary skill in the art, such as zippers, snaps, hook and loop fasteners or the like.

On the front side surface of the air mattress 102, there are located an inlet valve 115, an outlet valve 117, and a bi-directional valve 119, which are in gaseous or fluid communication with the chamber 120. On the front side surface of the air box spring 104, there are located an inlet valve 125, an outlet valve 127, and a bi-directional valve 129, which are in gaseous or fluid communication with the chamber 122. On the front side surface of the stabilizing tube 106, there is located a bi-directional valve 139. Preferably, the inlet valves 115, 125 are standard safety valves commercially available and known to those skilled in the art. Such valves are one-way valves, or self-sealing, which allow air flow into the chambers. A forceful stream of air from a foot pump, hand pump, compressed air container and the like can be introduced into the chambers 120 and 122 through these valves 115 and 125, respectively. In operation, the inlet safety valves are typically used to adjust the desired degree of inflation of the chambers. Preferably, the outlet valves 117 and 127, which are used to deflate the chambers, have wide openings for fast deflation. The bi-directional valves 119, 129, and 139 are used to manually adjust the volume of air in the chambers and the stabilizing tube and preferably have narrow openings for manipulating inflation and deflation. The structure of all of the valves, and the means by which they are connected to the surfaces, are commonly known to one of ordinary skill in the art.

The stabilizing tube 106 preferably contains only a bi-directional valve due its relatively smaller volume than that of the inflatable mattress 102 or the air box spring 104. The footprint of the inflatable mattress 102 is identical to that of the air box spring 104. By only situating the inflatable mattress 102 above the air box spring 104, the resulting structure is unstable. A user that places significant weight on the periphery of the top surface of the inflatable mattress would cause the entire structure to tilt up and pitch articles on the mattress and the user in the direction of the weight. Therefore, the purpose of attaching the stabilizing tube 106 to the outer periphery of the air box spring 104 is to provide stability to the inflatable bed 100 by increasing the footprint size of the inflatable bed 100.

The stabilizing tube 106, when inflated, preferably creates a larger footprint of the inflatable bed 100 than what would result without it. The increased footprint area results from the stabilizing tube 106 completely hemming the perimeter of the air box spring 104 at the bottom edge. The stabilizing tube 106 can be attached to the air box spring 104 by using such process as RF sealing or other process known to one of ordinary skill in the art or be fastened by using any suitable fastener known to one of ordinary skill in the art, such as zippers, snaps, hook and loop fasteners or the like. The increased footprint area results in a larger base for the inflatable bed, thereby providing additional stability.

The stabilizing tube 106 in effect also recesses the bottom layer 114 of the air box spring 104, thereby preferably creating an open cavity. The presence of the stabilizing tube 106 also decreases the surface contact area of the inflatable bed 100 with the ground surface. Instead of the inflatable bed 100 resting on the bottom layer 114 of the air box spring 104, the inflatable bed 100 is now at least partially supported by the stabilizing tube 106. The surface contact area of the stabilizing tube 106 is significantly less than the surface area of the bottom layer 114 of the air box spring 104. Consequently, heat loss and firmness of the sleeping surface are greatly diminished.

Figure 6:
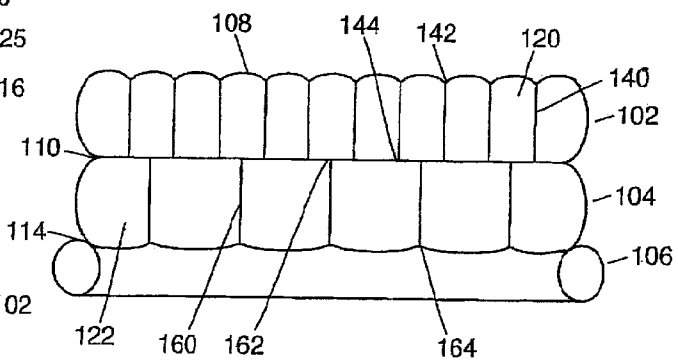
FIG. 6 illustrates a cross-sectional view of the first embodiment of the present invention.

FIG. 6 illustrates a cross-sectional view of the inflatable bed 100, showing the inner features. Within the chamber 120 of the inflatable mattress 102 is a series of longitudinally disposed vertical partitions or I-beam structures 140, which are heat or RF welded at 142 and 144 between the top layer 108 and bottom layer 110 defining the chamber 120 along their entire lengths. The I-beam structures 140 act as retention members and function to limit the outward expansion of the top and bottom layers 108, 110 of the chamber 120 and to absorb the weight differences created by the user. This type of retention member is well known to one of ordinary skill in the art of inflation devices, such as floatation devices. Alternatively, although I-beam retention members are shown, other retention members may be used in the present invention, including coil-like beam, tube-like beam, column-like beam, quilt beam and the like. In the preferred embodiment, there are approximately 8 to 12 I-beam structures 140 for a queen size mattress.

Also, in FIG. 6, another series of longitudinally disposed vertical partitions or I-beam structures 160, which are heat or RF welded at 162 and 164 between the layer 110 and bottom layer 114 defining the chamber 122. The purpose of these I-beam structures 160 is equivalent to that of the structures 140 described above. In the preferred embodiment, there are approximately 4 to 8 I-beam structures 160 for a queen size box spring.

Figure 8:
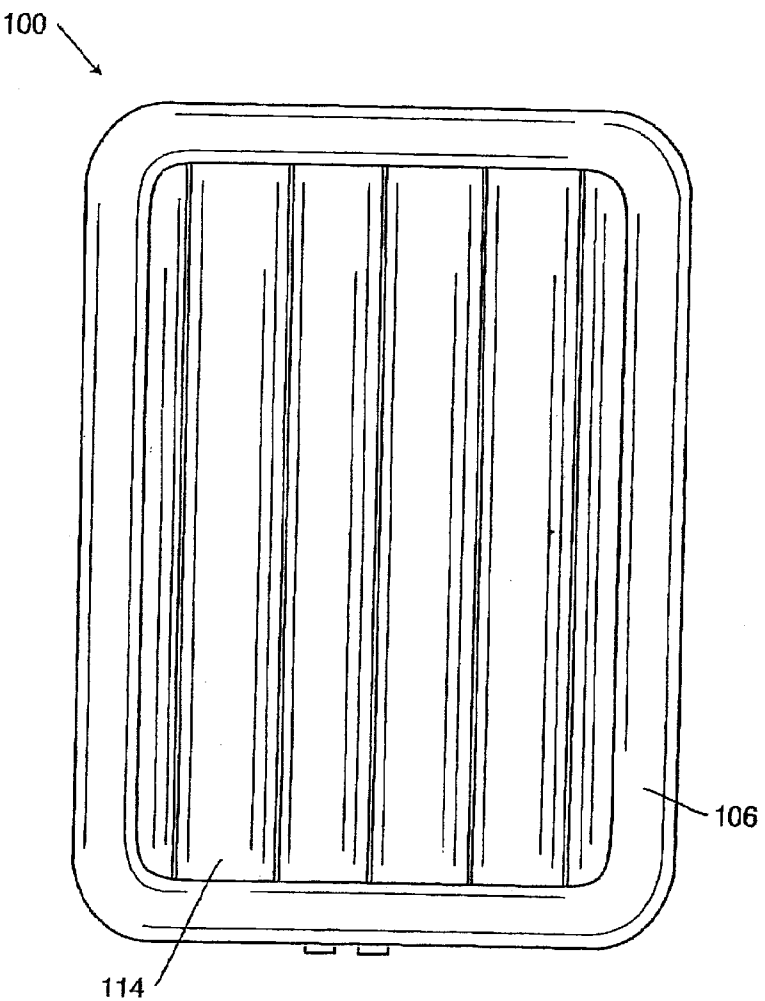
FIG. 8 illustrates a bottom plan view of the first embodiment of the present invention.
Figure 7:
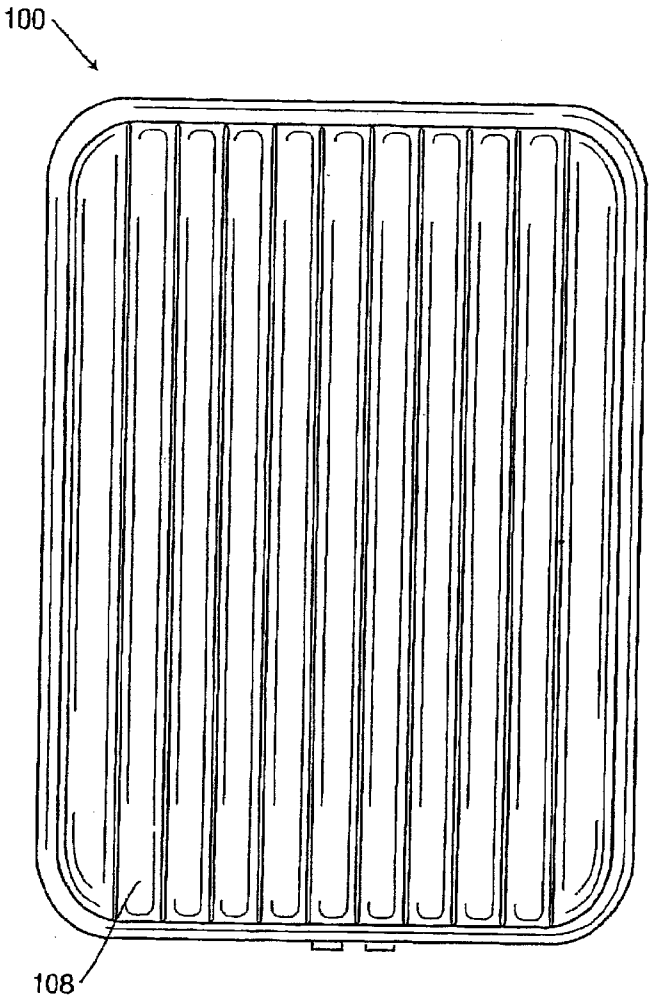
FIG. 7 illustrates a top plan view of the first embodiment of the present invention.

FIGS. 7 and 8 illustrate the top and bottom plan views, respectively, of the inflatable bed 100 in the preferred embodiment. In FIG. 7, the top layer 108 of the inflatable mattress 102 is shown with ridges created by the I-beam structures 140. The I-beam structures 160 in the chamber 122 create ridges on the bottom layer 114 of the air box spring 104, as seen in FIG. 8. These ridges provide additional comfort to the user. Also, the stabilizing tube 106 is shown to fully surround the air box spring 104 in both FIGS. 7 and 8.

Figure 9:
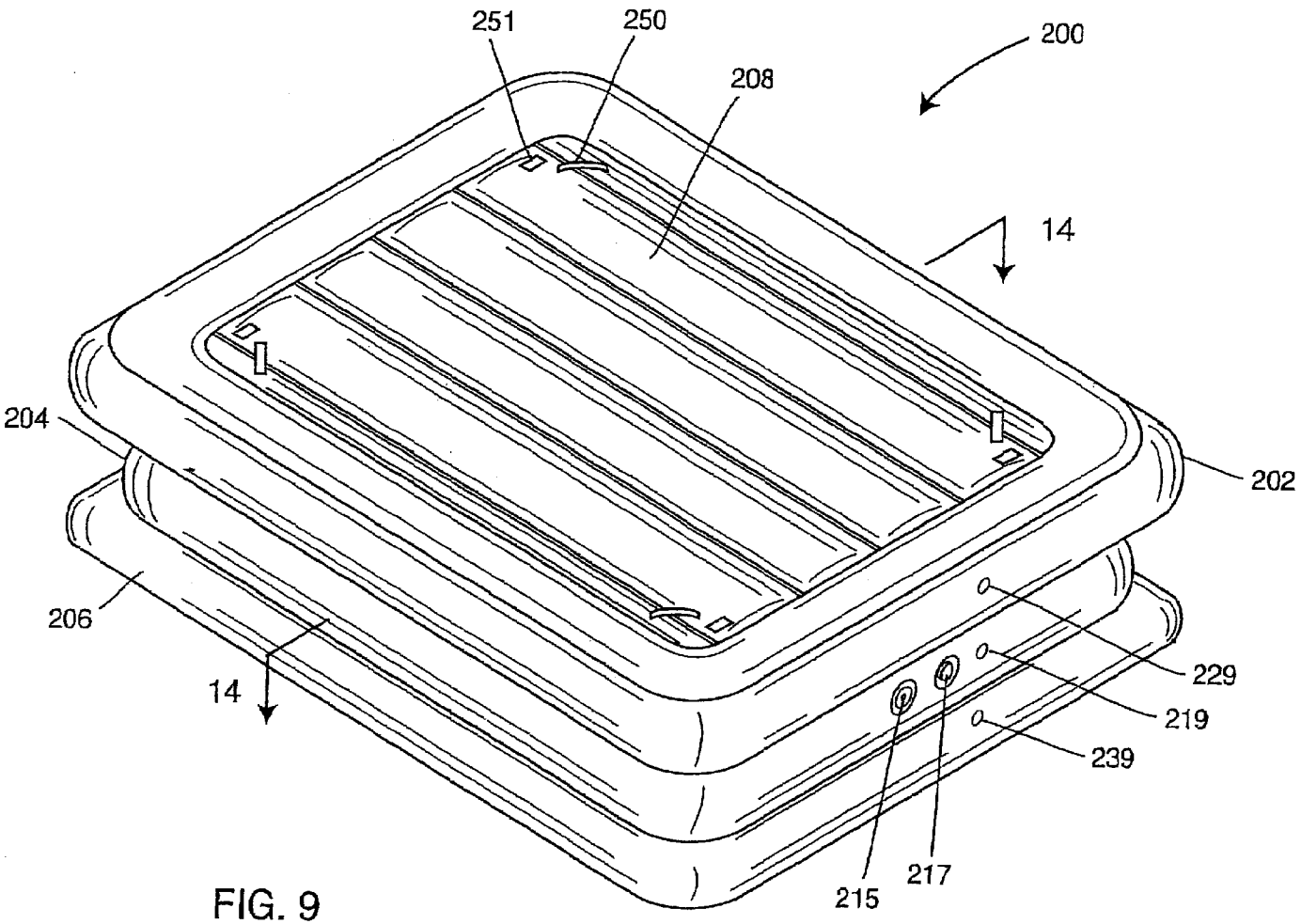
FIG. 9 illustrates a perspective view of an inflatable bed according to the second embodiment of the present invention.

FIGS. 9–16 illustrate an inflatable bed 200 according to a second embodiment of the present invention. A main difference between the first and second embodiments of the present invention is that the inflatable mattress, present in FIGS. 1–8, is not depicted since it is separate and detachable from the inflatable bed 200. The second embodiment allows the user to utilize the inflatable bed 200 with or without the inflatable mattress should space be limited or additional firmness be desired. FIG. 9 illustrates a perspective view of the inflatable bed 200 of the second embodiment of the present invention. FIGS. 10 and 11 illustrate posterior and frontal views, respectively, of the inflatable bed 200. FIGS. 12 and 13 illustrate right side and left side views, respectively, of the inflatable bed 200.

Referring to FIGS. 9–13, where the separate and detachable inflatable mattress is not shown, the inflatable bed 200 comprises a first airtight stabilizing tube 202 attached to the periphery of the top surface of the air box spring 204, and a second airtight stabilizing tube 206 attached to the periphery of the bottom surface of the air box spring 204. The inner perimeters of the stabilizing tube 202, 206 are preferably equivalent to the outer perimeter of the air box spring 204. The outer frame of the air box spring 204 comprises a top layer 208 sealed to a bottom layer 210 through a wall 212, thereby creating a chamber 220. The interior of the first stabilizing tubes 202 is in gaseous or fluid communication with the chamber 220 of the air box spring 204, whereas the interior of the second stabilizing tube 206 is not in gaseous or fluid communication with the chamber 220. The vertical direction arrows 14 in FIG. 9 refer to FIG. 14, which depicts the cross-sectional view of the inflatable bed 200.

In the second embodiment, material for layers 208, 210, wall 212, and stabilizing tubes 202, 206 are comprised of a flexible and resilient material, such as polyvinyl chloride sheeting (typically referred to as PVC), thermoplastic impregnated cloth or other materials known to one of ordinary skill in the art. The edges of the wall 212 are fused with the top and bottom layers 208, 210 using such process as RF sealing or other process known to one of ordinary skill in the art.

On the front side surface of the air box spring 204, there are located an inlet valve 215, an outlet valve 217, and a bi-directional valve 219, which are in gaseous or fluid communication with the chamber 220. On the front side surface of the second stabilizing tube 206, there is located a bi-directional valve 239. The bi-directional valves 219 and 239 are self-sealing, which allows air flow into the chambers (but must be pinched to allow air flow out of the chamber). Preferably, the inlet valve 215 is a standard safety valve commercially available and known to those of skill in the art. A forceful stream of air from a foot pump, hand pump, compressed air container and the like can be introduced into the chamber 220 through this valve 215. In operation, the inlet safety valve is typically used to adjust the desired degree of inflation of the chamber. Preferably, the outlet valve 217, which is used to deflate the chamber 220, has a wide opening for fast deflation. The bi-directional valves 219 and 239 are used to manually micro-adjust the volume of air in the chamber 220 and the stabilizing tubes and preferably have narrow openings for manipulating inflation and deflation. The structure of all of the valves, and the means by which they are connected to the surfaces, are commonly known to one of ordinary skill in the art.

In FIG. 9, the stabilizing tube 206 contains only the single bi-directional valve 239 due to its relatively smaller volumes than that of the air box spring 204. The purpose of the second stabilizing tube 206 is to provide stability and lessen the surface contact area of the inflatable bed, such as described above in the preferred embodiment. The purpose of the first stabilizing tube 202 is to provide stability for the separate and detachable inflatable mattress. The first stabilizing tube 202 in effect recesses the top surface of the air box spring 204, thereby creating a cavity in which the separate and detachable inflatable mattress is to be placed.

Unlike in the first embodiment where the inflatable mattress 102 is immobile because it shares a layer 110 with the air box spring 104, the separate and detachable inflatable mattress in the second embodiment is attached by straps 250 located at the edges of the top layer 208 of the air box spring 204, preferably in the corners. The straps 250 are preferably fused to the edge of the air box spring 204 by RF sealing. These straps 250 are then inserted into and through loops in corresponding areas on the bottom surface of the inflatable mattress. The ends of the straps 250 are then fastened to the top surface of the air box spring 204 by using any suitable fastener known to one of ordinary skill in the art, such as zippers, snaps, hook and loop fasteners or the like. Preferably, the ends of the straps 250 are fastened to the top surface of the air box spring 204 using hook and loop fasteners 251. Therefore, the ends of the straps 250 contain the corresponding fastening device to comply with the fastener 251. Once the inflatable mattress is fastened onto the top surface of the air box spring 204 by using the straps 250, the first stabilizing tube 202 acts as a cradle to further secure the inflatable mattress from sliding off the air box spring 204.

FIG. 14 illustrates a cross-sectional view of the inflatable bed 200, showing the inner features. Within the chamber 220 of the air box spring 204 is a series of longitudinally disposed vertical partitions or I-beam structures 240, which are heat or RF welded at 242 and 244 between the top layer 208 and bottom layer 210 defining the chamber 220 along their entire lengths. The I-beam structures 240 act as retention members and function to limit the outward expansion of the top and bottom layers 208, 210 of the chamber 220, to support the separate and detachable inflatable mattress and to absorb the weight differences created by the user. This type of retention member is well known to one of ordinary skill in the art of inflation devices, such as floatation devices. Alternatively, although I-beam retention members are shown, other retention members may be used in the present invention, including coil-like beam, tube-like beam, column-like beam, quilt beam and the like. In the preferred embodiment, there are approximately 4 to 8 I-beam structures 240 for a queen size air box spring.

Figure 16:
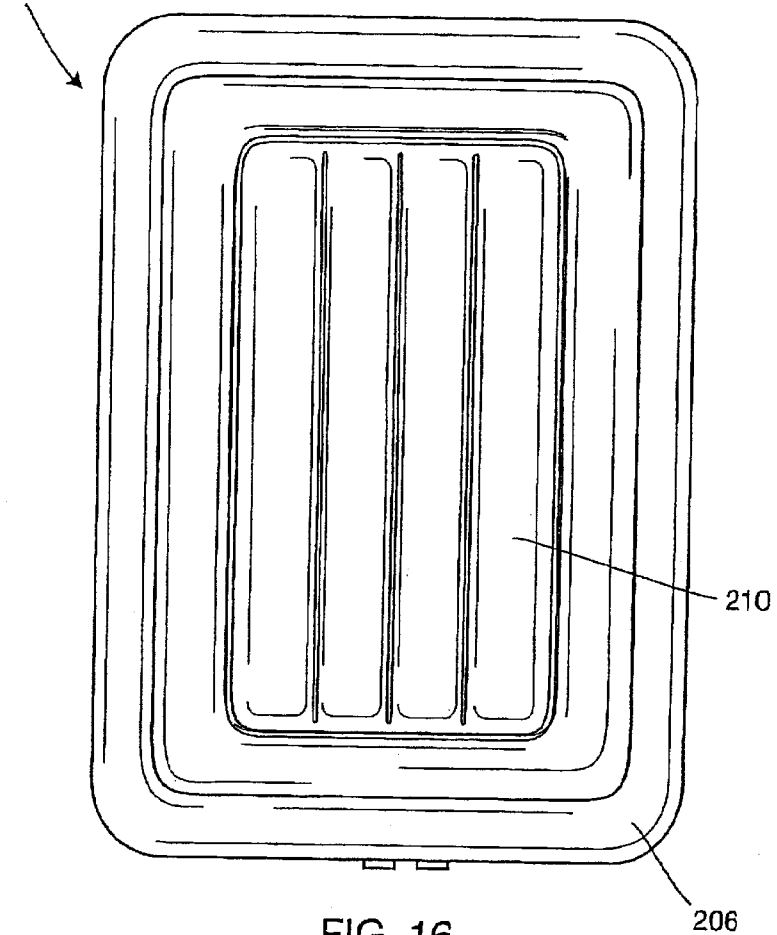
FIG. 16 illustrates a bottom plan view of the second embodiment of the present invention.
Figure 15:
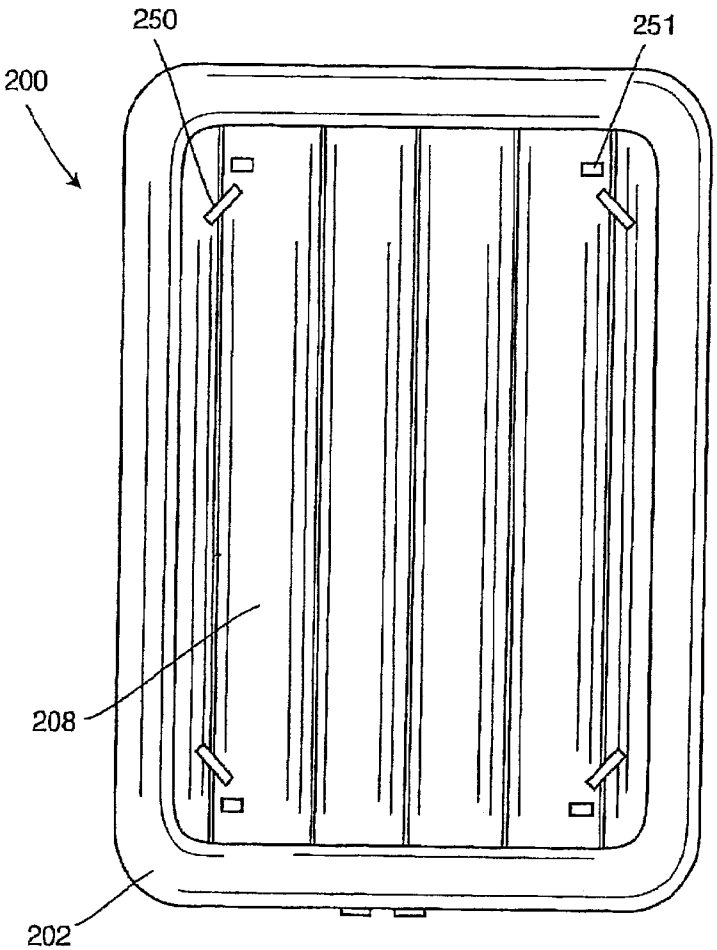
FIG. 15 illustrates a top plan view of the second embodiment of the present invention.

FIGS. 15 and 16 illustrate the top and bottom plan views, respectively, of the inflatable bed 200 of the alterative embodiment. In FIG. 15, the straps 250 and the hook and loop fasteners 251 are shown preferably in the corners of the top surface of the air box spring 204 to maximize the effectiveness of securing the inflatable mattress.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An inflatable bed comprising:

an inflatable mattress with a top layer sealed to a bottom layer through a wall, wherein the bottom and top layers and the wall define an outer frame of the inflatable mattress;

an inflatable box spring with a top layer sealed to a bottom layer through a wall, wherein the bottom and top layers and the wall define an outer frame of the inflatable box spring; and a stabilizing tube attached around a periphery of an outer frame of the bottom layer of the inflatable box spring to provide further stability wherein an outer periphery of the stabilizing tube is larger than the outer periphery of the inflatable box spring, and wherein an open cavity is formed between the bottom layer of the inflatable box spring and the stabilizing tube for decreasing the surface contact area between the inflatable box spring and a ground surface.

2. The inflatable bed of claim 1, wherein the bottom layer of the inflatable mattress is the same as the top layer of the inflatable box spring.

3. The inflatable bed of claim 1, wherein a plurality of I-beam sealing structures are longitudinally disposed between and are attached to a bottom surface of the top layer and a top surface of the bottom layer of the inflatable mattress.

4. The inflatable bed of claim 1, wherein a plurality of I-beam sealing structures are longitudinally disposed between and are attached to a bottom surface of the top layer and a top surface of the bottom layer of the inflatable box spring.

5. The inflatable bed of claim 1, wherein the inflatable mattress further comprises an inlet to inflate and an outlet to deflate the inflatable mattress.

6. The inflatable bed of claim 1, wherein the inflatable box spring further comprises an inlet to inflate and an outlet to deflate the inflatable box spring.

7. The inflatable bed of claim 1, wherein the stabilizing tube further comprises an inlet to inflate and deflate the stabilizing tube.

8. An inflatable bed comprising:

an inflatable mattress with a top layer sealed to a bottom layer through a wall, wherein the bottom and top layers and the wall define an outer frame of the inflatable mattress and wherein the inflatable mattress includes loop fasteners disposed on the bottom surface of the inflatable mattress;

an inflatable box spring with a top layer sealed to a bottom layer through a wall, wherein the bottom and top layers and the wall define an outer frame of the inflatable box spring;

a first stabilizing tube attached to the periphery of an outer surface of the top layer of the inflatable box spring to provide stability to the inflatable mattress disposed on the inflatable box spring; and a second stabilizing tube attached to a periphery of an outer surface of the bottom layer of the inflatable box spring to provide further stability.

9. The inflatable bed of claim 8, wherein the inflatable box spring further includes hook and loop fasteners and corresponding straps disposed on the top surface of the box spring so as to fasten to the corresponding loop fasteners disposed on the bottom surface of the inflatable mattress.

10. The inflatable bed of claim 8, wherein the inflatable mattress is detachable from the inflatable box spring.

11. The inflatable bed of claim 8, wherein the first stabilizing tube is in gaseous communication with the inflatable box spring.

12. The inflatable bed of claim 8, wherein the second stabilizing tube further comprises an inlet to inflate and deflate the second stabilizing tube.

13. The inflatable bed of claim 8, wherein an outer periphery of the second stabilizing tube is larger than an outer periphery of the inflatable box spring to provide stability.

14. An inflatable bed for use with an inflatable mattress, comprising:

an inflatable box spring with a top layer sealed to a bottom layer through a wall, wherein the bottom and top layers and the wall define an outer frame of the inflatable box spring;

a first stabilizing tube attached to the periphery of an outer surface of the top layer of the inflatable box spring to provide stability to an inflatable mattress disposed on the inflatable box spring; and a second stabilizing tube attached to a periphery of an outer surface of the bottom layer of the inflatable box spring to provide further stability wherein an outer periphery of the second stabilizing tube is larger than the outer periphery of the inflatable box spring, and wherein an open cavity is formed between the bottom layer of the inflatable box spring and the second stabilizing tube for decreasing the surface contact area between the inflatable box spring and a ground surface.

15. The inflatable bed of claim 14, wherein the first stabilizing tube is in gaseous communication with the inflatable box spring.

* * * * *